US011336065B2

(12) United States Patent
Kong et al.

(10) Patent No.: US 11,336,065 B2
(45) Date of Patent: May 17, 2022

(54) NETWORK JACK WITH SECURE CONNECTOR AND MAGNETICS

(71) Applicant: XFMRS, Inc., Camby, IN (US)

(72) Inventors: Weijia Kong, ZhongShan (CN); Yukun Liao, ZhongShan (CN); Liang Huang, ZhongShan (CN); Buddy Woods, Camby, IN (US)

(73) Assignee: XFMRS, Inc., Camby, IN (US)

( * ) Notice: Subject to any disclaimer, the term of this patent is extended or adjusted under 35 U.S.C. 154(b) by 0 days.

(21) Appl. No.: 16/666,082

(22) Filed: Oct. 28, 2019

(65) Prior Publication Data

US 2021/0104849 A1 Apr. 8, 2021

Related U.S. Application Data

(60) Provisional application No. 62/910,725, filed on Oct. 4, 2019.

(51) Int. Cl.

| | |
|---|---|
| ***H01R 3/00*** | (2006.01) |
| ***H01R 24/64*** | (2011.01) |
| ***H01R 13/66*** | (2006.01) |
| ***H01R 13/719*** | (2011.01) |

(52) U.S. Cl.

CPC ..... *H01R 24/64* (2013.01); *H01R 13/6633* (2013.01); *H01R 13/719* (2013.01)

(58) Field of Classification Search

CPC ..... H01R 13/7175; H01R 23/70073; H01R 23/7068; H05K 1/117

USPC ..... 439/490, 79, 55, 59

See application file for complete search history.

(56) References Cited

U.S. PATENT DOCUMENTS

| | | | | |
|---|---|---|---|---|
| 7,517,254 | B2 * | 4/2009 | Zhang | H01R 13/6658 439/541.5 |
| 2009/0253300 | A1 | 10/2009 | Huang et al. | |
| 2012/0142199 | A1 * | 6/2012 | Purkis | H01R 13/719 439/39 |
| 2012/0309236 | A1 * | 12/2012 | Purkis | H01R 13/719 439/668 |
| 2013/0045643 | A1 | 2/2013 | Hu et al. | |

OTHER PUBLICATIONS

Extended European Search Report corresponding to European Patent Application No. 20199779.8, dated Feb. 10, 2021 (8 pages).

* cited by examiner

*Primary Examiner* — Phuong Chi Thi Nguyen

(74) *Attorney, Agent, or Firm* — Maginot, Moore & Beck LLP

(57) ABSTRACT

A network jack includes a connector, an outer housing, and a circuit board. The connector receives a plug for conveying Ethernet network signals. The connector includes conductive leads disposed on opposite sides of a central bar. The connector has a connector housing formed in part by a plurality of walls defining an interior, wherein the central bar is disposed in the interior, and spaced part from each of plurality of walls. The outer housing is disposed about and contains the connector housing, and has a width approximately equal to a width of a housing of the plug. The circuit board is disposed within the housing, and supports a plurality of transformers and/or common-mode chokes. The circuit board provides at least a portion of an electrical connection between the conductive leads and the transformers and/or common mode chokes.

22 Claims, 7 Drawing Sheets

NETWORK JACK WITH SECURE CONNECTOR AND MAGNETICS

This application claims the benefit of U.S. Provisional Application Ser. No. 62/910,725 filed Oct. 4, 2019, and which is incorporated herein by reference.

TECHNICAL FIELD OF THE INVENTION

The present invention relates generally to network jack assemblies, and more specifically to a network jack having-built-in transformer and/or filter circuitry.

BACKGROUND ART

High speed communications circuit boards often incorporate various kinds of connectors by which telecommunication equipment are connected. One kind of connector is an IEC 60603-7 8P8C standard connector, which is commonly called an RJ-45 connector, used for high speed network communications. Typical high speed applications include networks such as Ethernet operating over a 10BASE-T, 100BASE-T lines, 1000BASE-T, as well as others.

A full 8P8C standard connection consists of a male plug and a female jack, each with eight equally-spaced contacts. On the plug, the contacts are flat metal strips positioned parallel to the connector body. Inside the jack, the contacts are metal spring wires arranged at an angle toward the insertion interface. When the plug is mated with the jack, the contacts meet and create an electrical connection. The spring tension of the jack contacts creates the interface. The housing can include a single spring loaded, thumb operated retention mechanism. Such connectors are ubiquitous in local area network environments.

The 8P8C standard connection suffers from the drawback in that the connectors can be damaged and or dislodged by inadvertent impact and/or mechanical stress. To address these issues, a new Ethernet connection system has been developed that incorporates a more robust physical connection, and one with a reduced footprint. This system, based on the standard IEC/PAS 620176-3-124, is available from Hirose Electric Co., Ltd. and Harting Industrial under the registered trademark ix Industrial®. The Hirose/Harting system includes a jack that has a central bar with vertically spaced connector on each side of the central bar. The central bar is surrounded by the receptacle housing. The corresponding plug 2, which is shown in FIG. 1B, has a base 4 that encloses the wire terminations and supports and reinforces the insertable plug portion 3. The base 4 has a width and height that exceeds the height and width of the insertable plug portion 3.

The insertable plug portion 3 is received within the receptacle housing of the jack such that plug surrounds the central bar. The contacts of the plug engage and electrically connect with the contacts on the central bar. The base of the corresponding plug includes an actuator 9*a* for controllably retracting a detent 9 on the insertable plug portion. The detent is configured to retain the plug within the receptacle housing. The jack includes traces that provide a direct conductive connection from each of the vertical space connectors to a corresponding pin that is mountable on a circuit board.

Even though the Hirose/Harting system employs shielded jacks to limit EMI, the devices still can be subject to cross-coupling of the radiation between adjacent pins, or on the traces of the circuit board to which they are mounted. In addition, digital transmissions generally are sensitive to noise artifacts. For these reasons, high speed communications boards usually include various filtering components in order to minimize unwanted cross-talk and provide the required isolation between the user and the line and filtering of undesirable noise to allow only the necessary frequency bandwidth to pass for accurate communication.

Noise suppressors, such as a common mode choke coil, are known in the art. The noise suppression circuitry is typically mounted on the PC motherboard and is connected in series with a network jack, which is also mounted to the PC board. However, such signal conditioning devices consume board real estate, which could otherwise be used to mount additional circuitry. The current jack design for use in the available systems implementing the IEC/PAS 61076-3-124 standard is designed for minimal size, and does not contain any room for additional components.

What is needed is a jack design for available plugs implementing IEC/PAS 61076-3-124 that avoids the problems associated noise and crosstalk without detracting from the miniaturization advantages enabled by the standard.

SUMMARY

At least some embodiments described herein address the problems by implementing a network jack that incorporates signal conditioning circuit in a way that conserves circuit board space.

In one embodiment, a network jack includes a connector, an outer housing, and a circuit board. The connector is configured to operably connect to a plug for conveying Ethernet network signals between the plug and the connector. The connector includes a first set of conductive leads disposed in an adjacent manner a first side of a central bar, and a second set of conductive leads disposed in an adjacent manner on a second side of the central bar. The connector has a connector housing formed in part by a plurality of walls defining an interior, wherein the central bar is disposed in the interior, and spaced part from each of plurality of walls. The outer housing is disposed about and contains the connector housing, and has a width approximately equal to a width of a housing of the plug. The circuit board is disposed within the housing, and supports a plurality of transformers and/or common-mode chokes. The circuit board provides at least a portion of an electrical connection between the conductive leads and the transformers and/or common mode chokes. The circuit board may alternatively, or in addition, include other filter circuitry.

Another embodiment is a network jack that also includes a connector, an outer housing and a circuit board. The connector is configured to operably connect to a plug for conveying Ethernet network signals between the plug and the connector. The connector includes a plurality of conductive leads disposed in a adjacent manner on a central bar. The connector has a connector housing formed in part by a plurality of walls defining an interior, wherein the central bar is disposed in the interior, and spaced part from each of plurality of walls. The outer housing is disposed about and contains the connector housing. The outer housing has a width approximately equal to a width of a housing of the plug. The circuit board is disposed within the outer housing. The circuit board supports a plurality of transformers, and provides at least a portion of an electrical connection between the conductive leads and the transformers.

The above-described features and advantages, as well as others, will become more readily apparent to those of ordinary skill in the art by reference to the following detailed description and accompanying drawings.

DETAILED DESCRIPTION

Figure 1A:
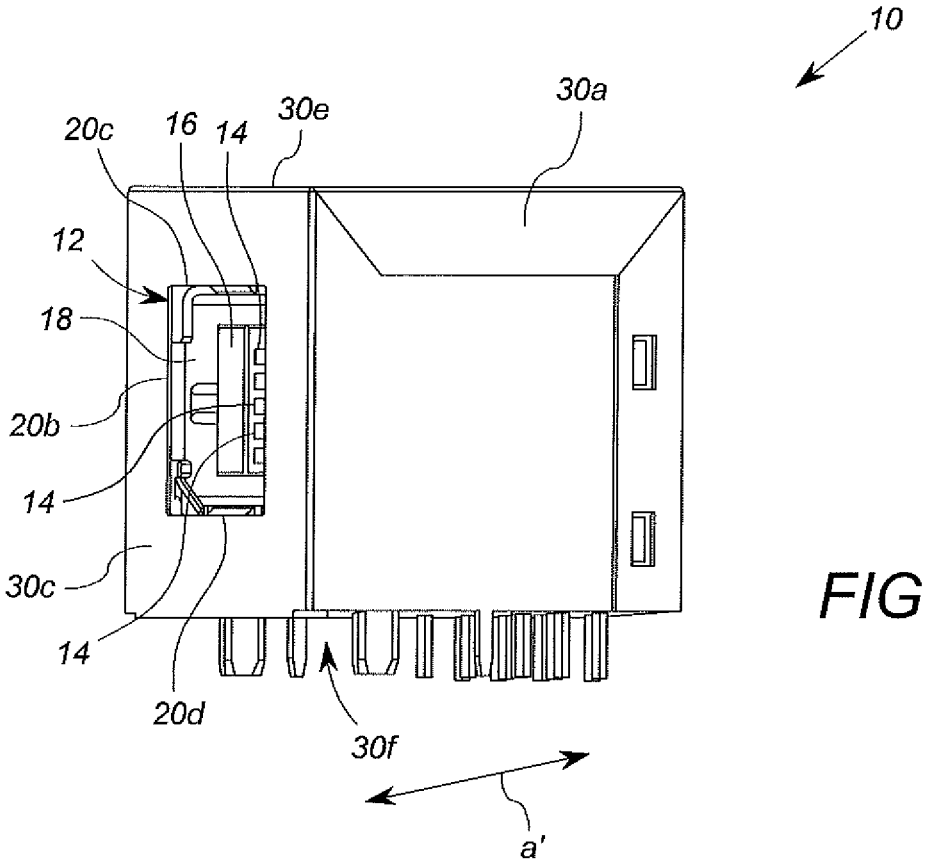
FIG. 1A shows a perspective view of a network jack according to a first embodiment.
Figure 1B:
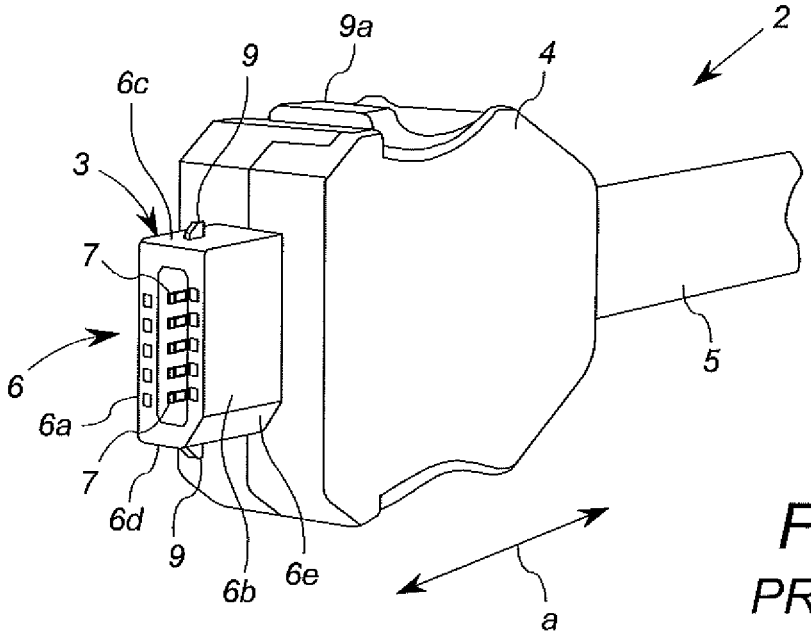
FIG. 1B PRIOR ART
FIG. 1B shows a perspective view of a prior art plug that can be used with the network jack of FIG. 1A.

FIG. 1A shows a perspective view of a network jack 10 according to a first embodiment, while FIG. 1B shows a perspective view of a cooperating prior art plug 2. FIGS. 1A and 1B show the jack 10 and plug 2 facing the same direction for clarity of exposition. In use, the plug 2 is oriented opposite that shown in FIG. 1B for insertion into the jack 10 as shown in FIG. 1A.

The plug 2 shown in FIG. 1B may suitably be the ix Industrial® plug (model IX40G-A-10S-CV(7.0)) available from Hirose Electric Company, Ltd., and includes a plug portion 3 and a case 4. The plug portion 3 extends outward (in the plugging direction a) from the case 4. The case 4 houses the terminations of the conductors within a network cable 5. As is known in the art, the case has a width of approximately 9 to 10 millimeters. The plug portion 3 includes a metal frame 6 having opposing side walls 6*a*, 6*b*, and top and bottom walls 6*c*, 6*d*, generally arranged as a rectangular structure, but having a chamfered edge 6*e* on one corner. The plug portion 3 also includes a plurality of metal conductive strips 7 that extend along the plugging direction a. More specifically, one set of the conductive strips 7 is disposed on a plate proximate to the first side wall 6*a*. Such strips 7 are disposed parallel to and spaced apart from each other, and face the opposing side wall 6*b*. The other set of the conductive strips 7 is disposed on another plate proximate to the second side wall 6*b*. Such strips 7 are similarly disposed parallel to and spaced apart from each other, and face the opposing side wall 6*a*.

The case 4 has a lateral width (perpendicular to the plugging direction a) that exceeds the lateral width of the plug portion 3, i.e. the distance between the outer surfaces of the side walls 6*a*, 6*b*. As discussed above, the case 4 has a lateral width in this embodiment of approximately 9 mm to 10 mm and the plug portion 3 has a lateral width of approximate 4 to 4.5 mm. The width of the case 4 exceeds the width of the plug portion 3 to, among other things, accommodate the wire terminations from the cable 5. The front face of the case 4, which interfaces with a corresponding jack, has a height of approximately 16 mm.

Figure 2:
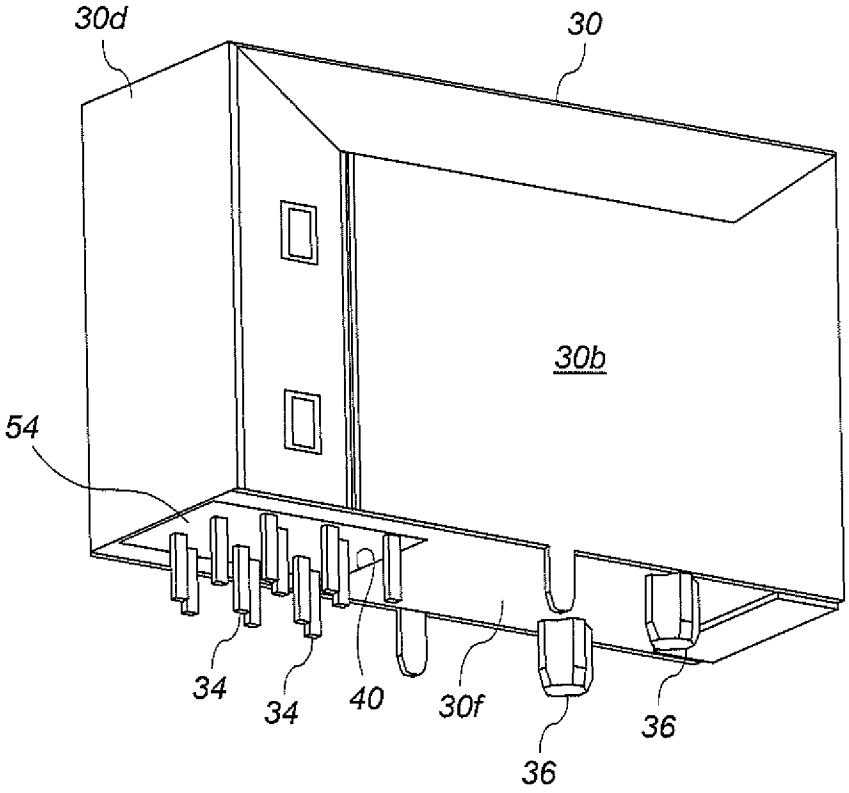
FIG. 2 shows a rear perspective view of the network jack of FIG. 1A.
Figure 3:
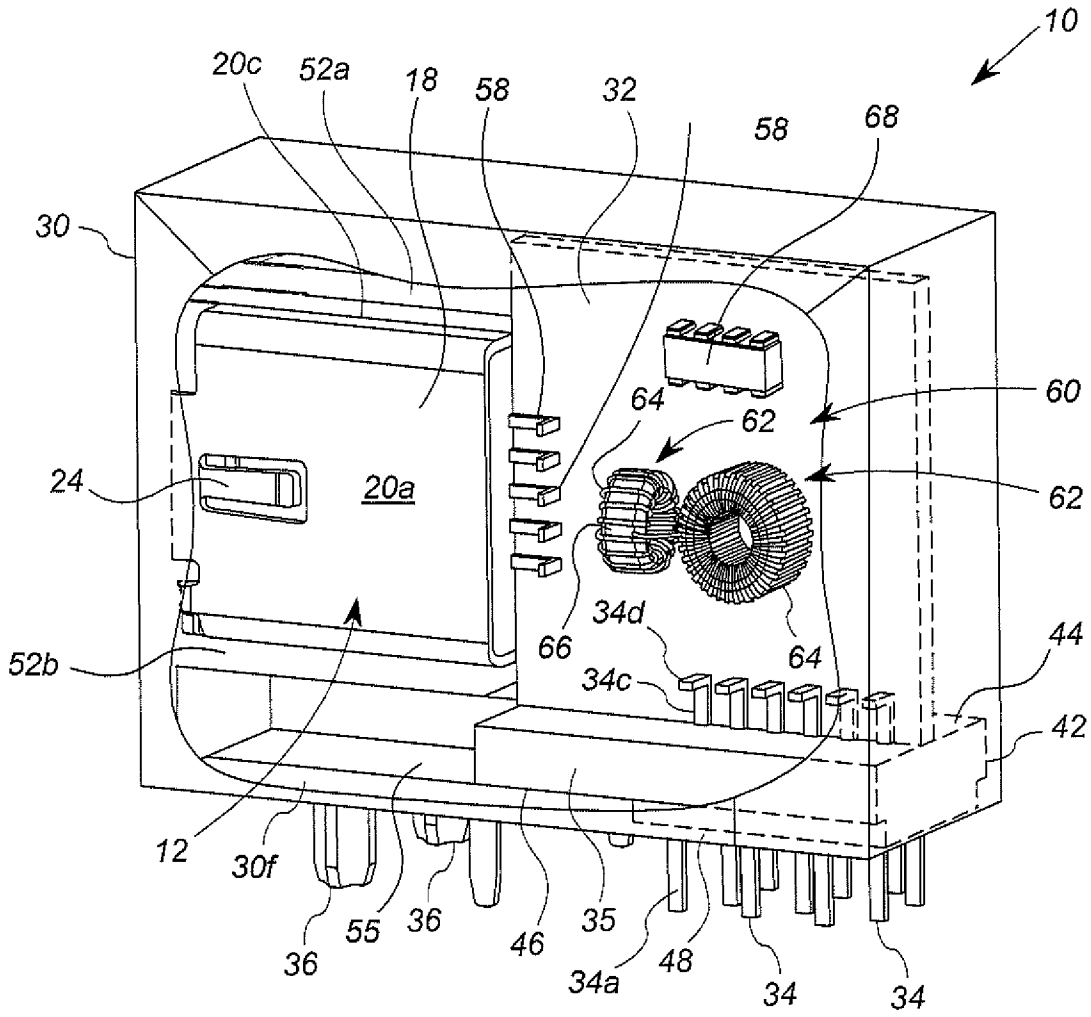
FIG. 3 shows a cutaway first perspective view of the network jack of FIG. 1A.
Figure 4:
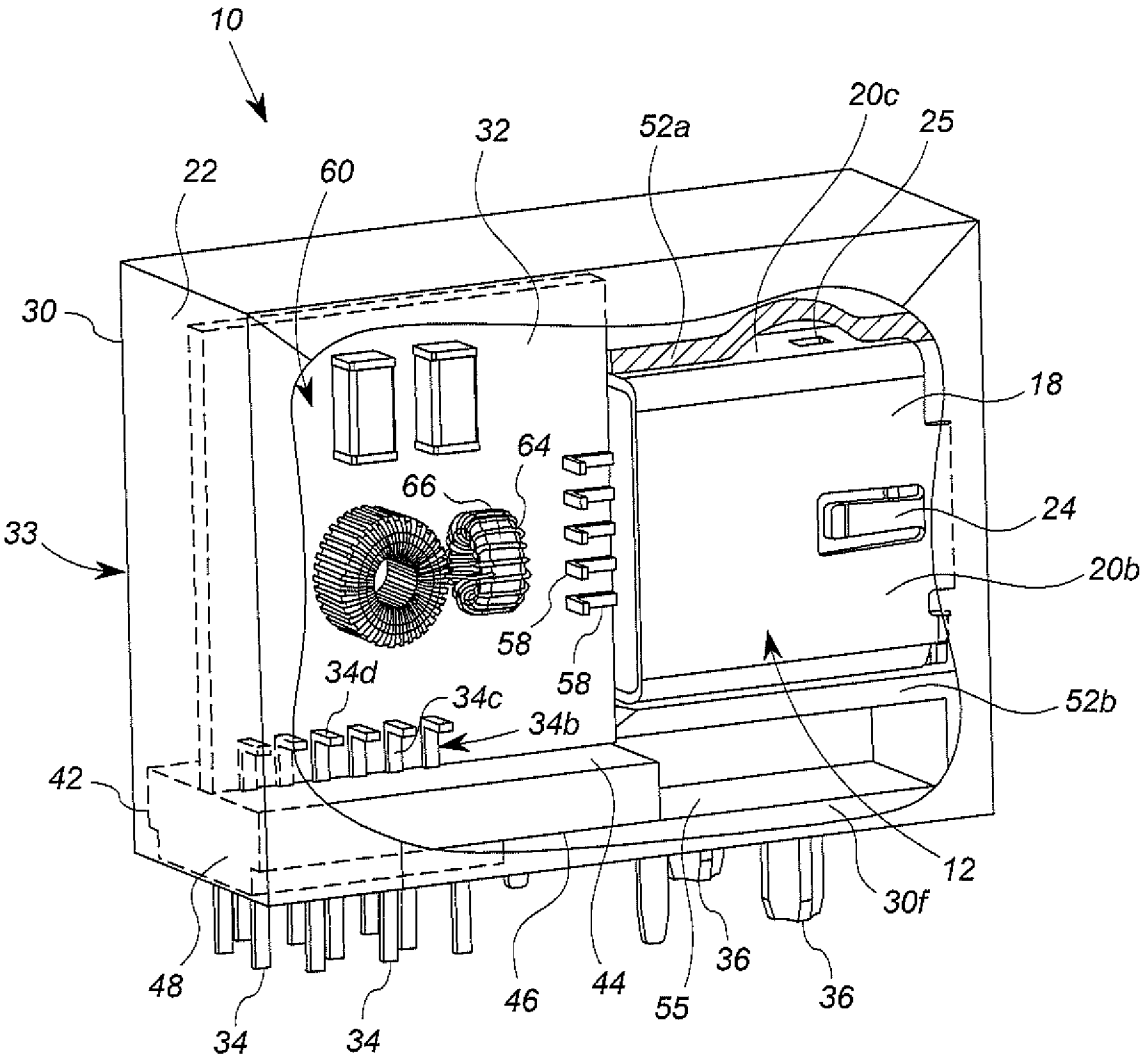
FIG. 4 shows a cutaway opposite side perspective view of the network jack of FIG. 1A.

In this embodiment, the network jack 10 (FIG. 1A) is configured to securely receive the plug portion 3 and provide electrical connection from the metal conductive strips 7 to, for example, a printed wiring board, not shown. For clarity of exposition, reference is also made to FIGS. 2 through 4. FIG. 2 shows a rear perspective view of the network jack 10, FIG. 3 shows a cutaway first perspective view of the network jack 10, and FIG. 4 shows a cutaway opposite side perspective view of the network jack 10. The network jack 10 includes a connector 12, an outer housing 30, a circuit board 32, a pin frame 35, and a plurality of pins 34.

Figure 5:
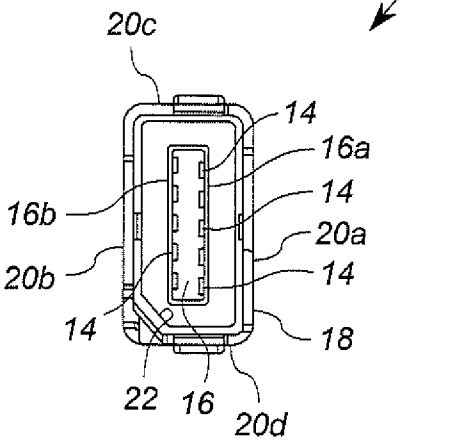
FIG. 5 shows a front cutaway view of a connector of the network jack of FIG. 1A.

The connector 12 is configured to receive (in the plugging direction a) and connect to the plug portion 3, such that Ethernet network signals propagate between the plug portion 3 and the connector 12. To this end, the connector 12 includes a plurality of conductive leads 14 and a connector housing 18. Reference is also made to FIG. 5, which shows a front cutaway view of the connector 12 removed from other elements of the jack 10.

The conductive leads 14 are disposed in a vertically adjacent manner on a central bar 16. It will be appreciated that the terms "vertical" and "horizontal" (and height and width) as used herein are used for convenience, and presume a frame of reference wherein the surface of the printed circuit board to which the jack 10 is to be connected defines the horizontal plane. A first set of the conductive leads 14 is disposed on a first surface 16*a* of the central bar 16, and a second set of conductive leads 14 is disposed on an a second, opposite, surface 16*b* of the central bar 16. In this embodiment, the leads 14 are spaced and disposed on the central bar 16 in a conventional manner to align with and connect to leads 7 on the plug 2.

The connector housing 18 is formed in part by a plurality of walls 20*a*-20*d* defining an interior 22. The central bar 16 is disposed in the interior 22, and is spaced part from each of plurality of walls 20*a*-20*d*. The connector housing 18 includes spring features 24 on the side walls 20*a*, 20*b* to assist in biasing the plug 2, not shown in FIGS. 1*b*, 2, 3, and 4, into position. The top and bottom walls 20*c*, 20*d* also include through holes 25 that are configured to cooperate with corresponding retractable detents 9 on the plug 2 to secure the plug 2 in an operably connected position. In general, the structural features of the connector may largely comprise those of prior art connectors for use with plugs such as the plug 2.

Figure 7A:
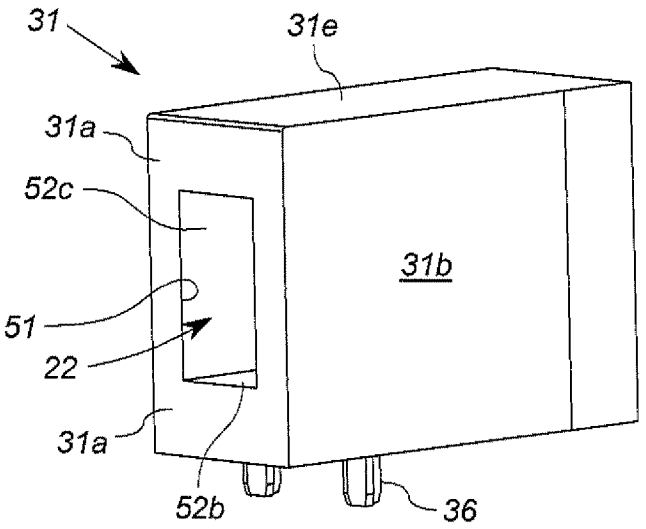
FIG. 7A shows a perspective view of the case of the network jack of FIG. 1A.
Figure 7B:
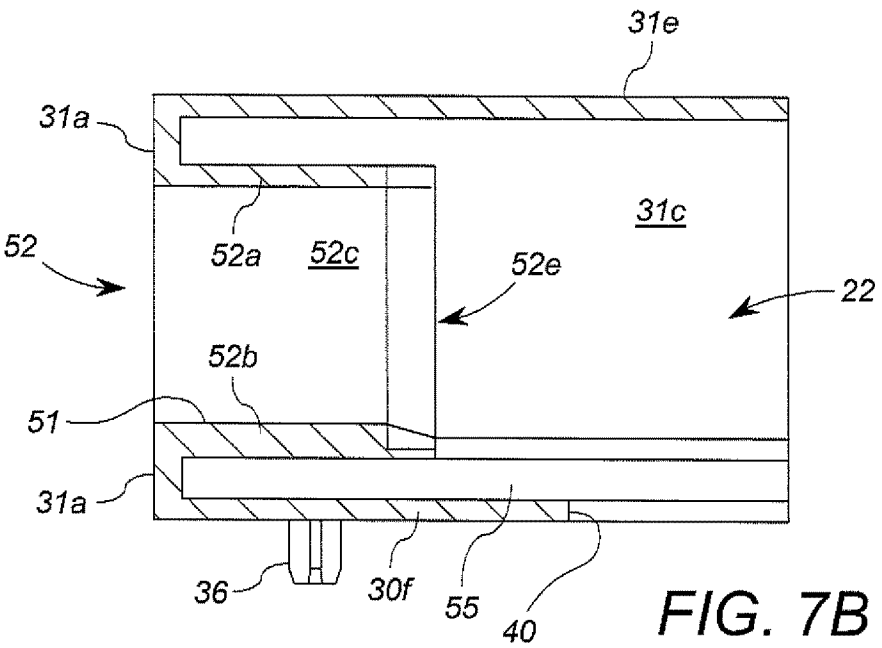
FIG. 7B shows, a side cutaway view of the case of FIG. 7A.
Figure 6:
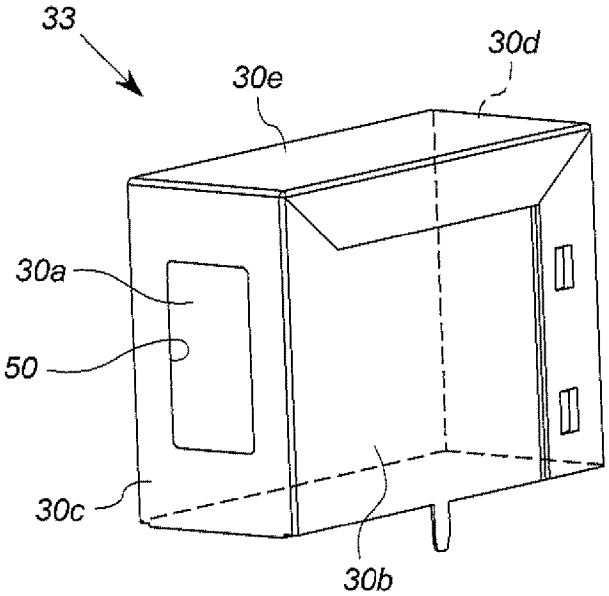
FIG. 6 shows a perspective view of the shield of the network jack of FIG. 1A.

The outer housing 30 is a container that is disposed about and contains the connector housing 18 and the circuit board 32. In this embodiment, the outer housing 30 includes a case 31 and a shield 33. FIG. 6 shows a perspective view of the shield 33 apart from the jack 10, and FIGS. 7A and 7B show, respectively, a perspective view and a side cutaway view of the case 31 apart from the jack 10. The case 31 is electrically non-conductive, and can be made of a molded polymer or plastic material. The case 31 is surrounded by the shield 33, which is in the form of a bent metal sheet skin, which assists in forming a Faraday cage. Thus, the outer dimensions of the outer housing 30 are largely defined by out dimensions of the shield 33. However, it will be appreciated that the housing 30 may take other suitable forms, so long as the dimensions are consistent as defined herein.

In general, the outer housing 30 has a width that is approximately equal to a width of the case 4 of the plug 2, for example, approximately 9 mm to 10 mm. As a result, the minimum spacing between the outer housing 30 and similar outer housings of adjacent jacks (having the design of the jack 10) is the same as prior art devices. Specifically, in the prior art devices, the minimum spacing between jacks was defined by the width of the plug 2, and specifically, the case 4. In the embodiment described herein, the width of the jack 10 is increased to the same width as the case 4 to accommodate additional circuitry within the case, while not requiring any larger footprint.

In this embodiment, the outer housing 30 has size sides in the shape of a rectangular box, including a first side 30*a*, an opposing second side 30*b*, a front side 30*c*, a rear side 30*d*, a top side 30*e*, and bottom side 30*f*. With reference to FIGS. 1A and 6, the shield 33 is in the form of an open bottom box that defines most of the outer periphery of the outer housing 30. Thus, the shield 33 includes and defines the first side 30*a*, the opposing second side 30*b*, the front side 30*c*, the rear side 30*d*, and the top side 30*e* of the outer housing 30. It will be appreciated that in other embodiments, the outer housing 30 may take other shapes, but should nevertheless have a maximum width that that does not significantly exceed that of the case 4 of the plug 2.

Referring again to the embodiment described herein, the front side 30*c* is a wall having a main rectangular surface extending that is perpendicular to the plugging direction a, and which extends from the top side 30*e* to the bottom side 30*f* (not part of the shield 33), and from the first side 30*a* to the second side 30*b*. The front side 30*c* thus has a width that is greater than the width of the connector housing 12, and preferably has a width of approximately 9 mm to 11 mm in this embodiment. The front side 30*c* includes a plug opening 50 through which the plug portion 3 of the plug may be received. The plug opening 50 is aligned with the open end of the connector housing 12 such that plug portion 3 may pass through the plug opening 50 and into the connector housing 12. The rear side 30*d*, shown in phantom in FIG. 6, is a wall having a main rectangular surface having the same length and width of the front side 30*c*. The rear side 30*d* is disposed parallel to and aligned with the bottom side 30*f*.

With reference to FIGS. 1A, 2, 7A, and 7B, the case 31 is in the form of an open-ended box sized to substantially fit within the interior of the shield 33. The case 31 includes first and second sides 31*b*, 31*c* that are adjacent to and preferably abut, respectively, the first and second sides 30*a*, 30*b* of the shield 33. The case 31 also includes a front side 31*a* that is adjacent to and preferably abuts the front side 30*c* of the shield 33. The front side 31*a* includes a plug opening 51 sized to receive the plug portion 3 (see FIG. 1B) therethrough. In this embodiment, the plug opening 51 is rectangular in shape, and substantially the same size and shape as the opening 50. The case 31 further includes a top side 31*e* that is adjacent to and preferably abuts the top side 30*e* of the shield 33.

Referring specifically to FIGS. 2 and 7B, the case 31 also includes a bottom that defines the bottom side 30*f* of the outer housing 30. The bottom side 30*f* is configured to be disposed nearest the circuit board, not shown, and is a wall having a main rectangular surface that extends in the plugging direction a from the front side 31*a* toward the rear side 30*d* of the shield 33, and extends between the first side 31*a* and the second side 31*b* of the case 31. In this embodiment, the bottom side 30*f* is substantially parallel to the printed circuit board, not shown, to which the network jack 10 is to be attached.

The bottom side 30*f* does not extend all the way to the rear side 30*d*, but rather ends about two-thirds of the length, leaving a void 40 in which a portion of the pin frame 35 is disposed, as will be discussed further below in detail. The bottom side 30*f* in this embodiment also includes two pedestals 36 extending downward (away from the interior 22) disposed nearer the front side 30*c* than the rear side 30*d*. The pedestals 36 are non-conductive spacers that provide support to the front portion of the outer housing 30.

With reference to FIGS. 7A, 7B, the case 31 also includes a connector receptacle 52 in the form of an open-ended rectangular box configured to receive and support the connector 12 within the interior 22. In this embodiment, the connector receptacle 52 has a top wall 52*a*, a bottom wall 52*b*, a first side wall 52*c*, and a second side wall, not shown, but which is substantially similar to the first side wall 52*c*. The top wall 52*a* extends rearward, parallel to the top side 31*e* of the case 31, from a top edge of the opening 50. The top wall 52*a* extends less than halfway to the rear side 30*d* of the shield 33. The bottom wall 52*b* extends coextensively rearward, parallel to the top wall 52*a*, from a bottom edge of the opening 50. The first side wall 52*c* also extends coextensively rearward from a side edge of the opening 50, parallel to the first and second sides 31*b*, 31*c* of the case 31. The second side wall similarly extends coextensively rearward from the other side edge of the opening 50. The connector 12 is secured within and supported by the connector receptacle 52. The connector receptacle 52 has as open rear 52*e* to allow for connections (pins 58) between the circuit board 32 and the connector 12.

As shown in FIGS. 2-4, the pin frame 35 is disposed partially within the void 40 in the outer housing 30. The pin frame 35 is configured to support the terminal pins 34 at positions below outer housing 30 that allow the terminal pins 34 to insert into holes in a printed circuit board, not shown, for electrical connection thereto. The pin frame 35 is a polymer (or otherwise non-conductive) base 54 molded over the conductive pins 34 such that each conductive pin 34 has a first end 34*a* that extends downward and may be received a circuit board, and a second end 34*b* that provides an electrical connection to the first end 34*a* within the interior 22.

Figure 8B:
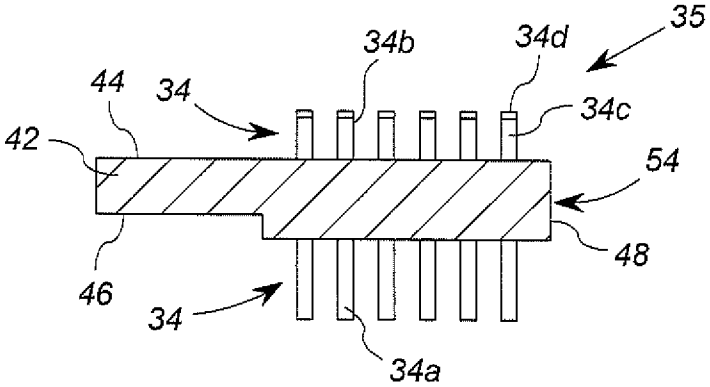
FIG. 8B shows a side cross section of the pin frame of FIG. 8A.
Figure 8A:
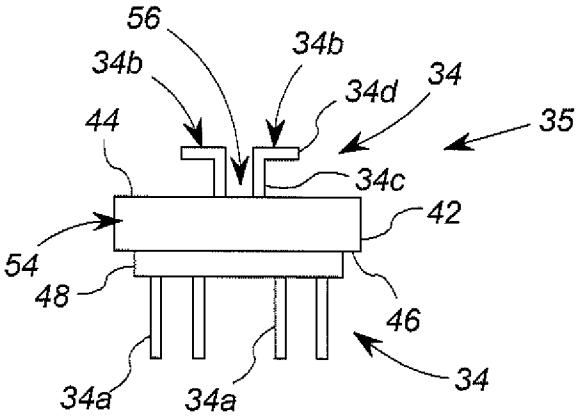
FIG. 8A shows an end plan view of the pin frame of the network jack of FIG. 1A.

FIGS. 8A and 8B show the pin frame 35 in further detail apart from the connector 12, the outer housing 30, the circuit board 32, and other elements of the network jack 10. FIG. 8A shows an end plan view of the pin frame 35, and FIG. 8B shows a side cross section of the pin frame 35. Referring specifically to FIGS. 3, 4, 8A and 8B and 4, the polymer base 54 of the pin frame 35 comprises a two-tiered plate or bar formed of an insulating polymer or other insulating material. Specifically, the polymer base 54 comprises a rectangular bar 42 having a top surface 44 and a bottom surface 46. The bottom surface 46 extends in part along and rests on top surface 55 of the bottom side 30*f* of the outer housing 30. The pin frame 35 also includes a pedestal 48 disposed on the bottom surface 46 of the rectangular bar 42. The pedestal 48 is sized and configured to reasonably fit the void 40 in the bottom side 30*f* of the outer housing 30. In this embodiment, the pedestal 48 and void 40 are rectangular. However, it will be appreciated that the pedestal 48 and void 40 may take other shapes that fit together.

In the example of FIGS. 3, 4, 8A and 8B, the pin frame 35 includes twelve pins 34 molded therein. The first ends 34*a* of the pins 34 are arranged to four rows of three pins 34. FIG. 8A shows the four rows from the end, and FIG. 8B shows two rows of three, which have staggered placement as shown in FIGS. 3 and 4. In this embodiment, the first end 34*a* of each pin is straight. However, in other embodiments, the first end 34*a* may be L-shaped or gull-wing shaped for use as a surface mount device. Referring again to the embodiment of FIGS. 3, 4, 8A and 8B, the second ends 34*b* of the pins 34 are arranged in two aligned rows of six pins 34. Each second end 34*b* of each pin 34 has an upright portion 34*c* that extends upward, and an outward extension 34*d* that extends outward away from the second ends 34*b* of pins 34 of the other row. In this embodiment, each second end 34*b* is L-shaped, such that the outward extension 34*d* extends at substantially perpendicular angle away from the upright portion 34*c*. In other embodiments, the outward extension 34*d* may extend outward at other angles.

The upright portions 34*c* of the pins 34 form two rows defining a passage 56 therebetween. The passage 56 has a width approximately equal to a thickness of the circuit board 32, such that the circuit board 32 can be vertically retained in the passage by the two rows of upright portions 34*c*. The upright portions 34*c* furthermore contact lands and/or other conductive strips, not shown, on the circuit board 32 to make electrical connections to the electrical elements thereon.

As shown in FIGS. 3 and 4, the connector 12 also includes pins 58 that form a channel for receiving an edge of the circuit board 32. When the connector 12 is secured within and supported by the connector receptacle 52, and the pin frame 33 is secured within the void 40, the pins 34 and the pins 58 form a receptacle for the circuit board that physically supports the circuit board 32. The pins 34 provide an electrical connection between the circuit board 32 and an external printed circuit board, not shown. The pins 58 provide an electrical connection between the connector 12 (and specifically conductive leads 14) and the circuit board 32.

The circuit board 32 includes a plurality of elements that form a signal conditioning circuit 60. The signal conditioning circuit 60, among other things, electrically couples the pins 58 and the pins 34. The circuit board 32 also includes suitable traces, not shown in FIGS. 3 and 4, that provide appropriate electrical connections among the circuit elements and the pins 34 and 58. The signal conditioning circuit 60 provides isolation and reduces cross-talk, and can take a plurality of known forms used process Ethernet signals received on an Ethernet cable to signals for use by a data receiving circuit. Such a circuit can include one or more chokes and/or transformers and/or other filter circuitry. Such chokes or transformers are mounted on the circuit board 32, and are connected via traces and possibly other elements, not shown, to the pins 58 and 32.

Figure 9:
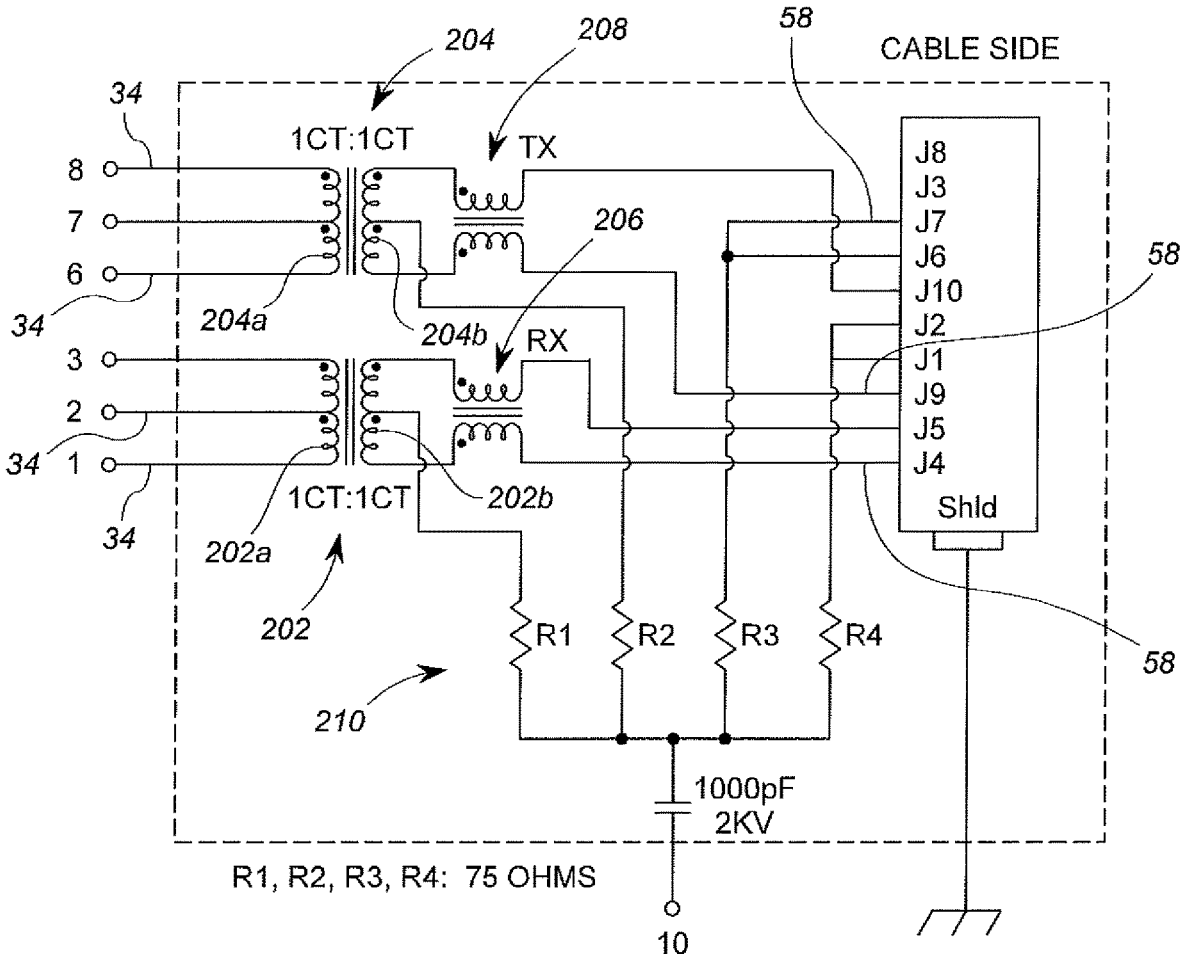
FIG. 9 shows a schematic of an exemplary conditioning circuit that may be used in the network jack of FIG. 1A.

FIG. 9 shows a schematic of an exemplary conditioning circuit 60. The conditioning circuit includes two isolation transformers 202 and 204. Each of the isolation transformers 202, 204 is a center tap transformer having a respective primary winding 202*a*, 204*a* connected to corresponding pins 34, and a respective secondary winding 202*b*, 204*b*. Each of the secondary windings 202*b*, 204*b* is operably coupled to corresponding pins 58 via a corresponding common-mode choke 206, 208. Each is of the secondary windings 202, 204 furthermore has a center tap connection to a termination 210, which is further operably coupled to corresponding pins 58. The termination 210 (which may include filtering functionality) in this embodiment is a Bob Smith termination includes four resistors R1, R2, R3 and R4 all having one end connected to a 1000 pF capacitor, which is further coupled to ground. The other end of resistors R1 and R2 are coupled to the center taps of respective secondary winding 202*b*, 204*b*, and the other ends of resistors R3 and R4 are coupled to corresponding pins 58. While the above circuit represents a conditioning circuit suitable for 10/100 Ethernet connections, many other variants of Ethernet conditioning circuits may be used, including those that support PoE and 1000Base-T Ethernet.

One of the advantages of the embodiments described herein is that the magnetic elements of the conditioning circuit 60 (and variants thereof) are disposed within the outer housing 30, with little or no sacrifice of usage of external circuit board space beyond that normally used for a similar connector without conditioning elements. Referring again to FIGS. 3 and 4, the conditioning circuit 60 supported within the external housing 30 includes transformers 62 and/or filter circuitry disposed on the circuit board 32. In this embodiment, each of the transformers 62 comprises a toroid having transformer windings 64 disposed around a ring-shaped core 66. The circuit board 32 can also support transformers and/or common mode chokes (and/or filter circuitry) disposed within a molded case 68 mounted to the circuit board 32. Still other embodiments can include transformers and/or chokes having a core frame that mounts to the circuit board 32, such as that disclosed in U.S. patent application Ser. No. 15/815,204, filed Nov. 16, 2017, which is incorporated herein by reference.

As shown in FIGS. 3 and 4, the circuit board 32 in this embodiment preferably includes components (magnetic components and/or other electrical components) mounted on both sides for circuit board 32 size reduction.

In use, the pins 34 and pedestals 36 may suitably be secured via corresponding openings in a printed circuit board, not shown, that contains circuitry for transmitting and receiving information via a suitable Ethernet protocol. The plug portion 3 is received into the connector 12 such that the conductive leads 7 on the plug 2 physically touch and are electrically coupled to the conductive leads 14 on the center bar 16 of the connector 12. Signals received from the plug 2 propagate via the pins 58 to signal conditioning circuit 60 to the circuit board 32. The signal conditioning circuit 60 conditions the received signals and provides conditioned received signals to the second pin portion 34*b*. The signals propagate to the first pin portion 34*a* and thus to external devices on the external printed circuit board, not shown. Multiple jacks 10 can be disposed adjacent to each other on the same external printed circuit board, using the same space as prior art network jacks configured for receiving the plug 2, without conditioning circuitry.

It will be appreciated that the above-described embodiments are merely exemplary, and that those of ordinary skill in the art may readily devise their own implementations and modifications that incorporate the principles of the present invention and fall within the spirit and scope thereof.

What is claimed is:

1. A network jack comprising:

a connector configured to operably connect to a plug for conveying Ethernet network signals between the plug and the connector, the connector including a first set of conductive leads disposed in an adjacent manner on a first side of a central bar, and a second set of conductive leads disposed in an adjacent manner on a second side of the central bar, the connector having a connector housing formed in part by a plurality of walls defining an interior, wherein each of the central bar, the first set of conductive leads, and the second set of conductive leads are disposed in the interior, and the central bar is spaced part from each of plurality of walls;

an outer housing disposed about and containing at least a part of the connector housing, the outer housing having a width approximately equal to a width of a housing of the plug;

a circuit board disposed within the outer housing, the circuit board supporting a plurality of transformers and/or a plurality of common-mode chokes and/or filter circuitry, the circuit board providing at least a portion of an electrical connection between the conductive leads and the transformers and/or common mode chokes and/or filter circuitry.

2. The network jack of claim 1, wherein the circuit board supports the plurality of transformers, and wherein:

the transformers form part of a set of electrical components mounted to the circuit board;

at least one of the transformers is disposed closer to a first surface of the circuit board than to a second surface of the circuit board; and at least one of the electrical components is disposed closer to the second surface of the circuit board than to a first surface of the circuit board.

3. The network jack of claim 1, wherein the outer housing has a width that extends between one and three millimeters beyond the housing of the plug.

4. The network jack of claim 3, wherein the outer housing has a width of approximately 10 millimeters.

5. The network jack of claim 1, wherein the first set of conductive leads are disposed on a first surface of the first side of a central bar, and the second set of conductive leads are disposed on a second surface of the second side of the central bar.

6. The network jack of claim 5, wherein the first surface and the second surface face opposite directions.

7. The network jack of claim 1, further comprising a plurality of pins, each of the plurality of pins electrically connected to the circuit board and extending out of the outer housing, each of the plurality of pins configured to electrically connect to an external circuit board.

8. The network jack of claim 7, wherein the circuit board includes the plurality of common-mode chokes operably connected to at least one of the plurality of transformers.

9. The network jack of claim 8, wherein the transformers comprise toroids disposed on the circuit board.

10. The network jack of claim 9, wherein each of the transformers comprises transformer windings disposed around a core.

11. A network jack comprising:

a connector configured to operably connect to a plug for conveying Ethernet network signals between the plug and the connector, the connector including a plurality of conductive leads disposed in a vertically adjacent manner on a central bar, the connector having a connector housing formed in part by a plurality of walls defining an interior, wherein the central bar is disposed in the interior, and spaced part from each of plurality of walls;

an outer housing disposed about and containing at least a part of the connector housing, the outer housing having a width approximately equal to a width of a housing of the plug;

a circuit board disposed within the outer housing, the circuit board supporting a plurality of transformers, the circuit board providing at least a portion of an electrical connection between the conductive leads and the transformers.

12. The network jack of claim 11, wherein at least one of the transformers comprises a toroid.

13. The network jack of claim 12, wherein the outer housing has a width of approximately between 9 millimeters and 10 millimeters.

14. The network jack of claim 11, further comprising a pin frame disposed at a bottom of the outer housing, the pin frame having a base molded about a plurality of conductive pins.

15. The network jack of claim 14, wherein each of the plurality of conductive pins includes a first portion extending out of the bottom of the outer housing, and a second portion extending at least in part vertically out of the top of the pin frame base.

16. The network jack of claim 15, wherein the circuit board is supported at least in part by the pin frame.

17. The network jack of claim 11, wherein the outer housing comprises a case configured to support the connector housing, and a metal shield surrounding the case, the case formed of an electrically insulating material.

18. The network jack of claim 17, further comprising a pin frame disposed at a bottom of the outer housing, the pin frame having a base molded about a plurality of conductive pins.

19. The network jack of claim 18, wherein the pin frame includes a first portion supported on the case, and a second portion disposed adjacent an opening in the case and an opening in the metal shield.

20. The network jack of claim 19, wherein the pin frame includes a bar and a pedestal, at least a portion of the bar disposed on and supported on a surface of the case, and the pedestal disposed in and substantially fitting at least the opening in the metal shield.

21. A network jack comprising:

a connector configured to operably connect to a plug for conveying Ethernet network signals between the plug and the connector, the connector including a plurality of conductive leads disposed in a vertically adjacent manner on a central bar, the connector having a connector housing formed in part by a plurality of walls defining an interior, wherein the central bar is disposed in the interior, and spaced part from each of plurality of walls, wherein the connector housing includes spring features configure to secure the plug in an operably connected position;

an outer housing disposed about and containing at least a part of the connector housing, the outer housing having a width approximately equal to a width of a housing of the plug;

a plurality of transformers disposed within the outer housing, the plurality of transformers electrically coupled to the conductive leads.

22. The network jack of claim 21, wherein the outer housing has a width of approximately between 9 millimeters and 10 millimeters.

* * * * *